US010861391B2

(12) United States Patent
Yan

(10) Patent No.: US 10,861,391 B2
(45) Date of Patent: Dec. 8, 2020

(54) OLED ILLUMINATION COMPENSATING METHOD AND DEVICE

(71) Applicant: Wuhan China Star Optoelectronics Semiconductor Display Technology Co., Ltd., Wuhan (CN)

(72) Inventor: Weinan Yan, Wuhan (CN)

(73) Assignee: Wuhan China Star Optoelectronics Semiconductor Display Technology Co., Ltd., Wuhan (CN)

( * ) Notice: Subject to any disclaimer, the term of this patent is extended or adjusted under 35 U.S.C. 154(b) by 0 days.

(21) Appl. No.: 16/325,404

(22) PCT Filed: Nov. 6, 2018

(86) PCT No.: PCT/CN2018/114116

§ 371 (c)(1),
(2) Date: Feb. 14, 2019

(87) PCT Pub. No.: WO2020/024475

PCT Pub. Date: Feb. 6, 2020

(65) Prior Publication Data

US 2020/0126484 A1 Apr. 23, 2020

(30) Foreign Application Priority Data

Aug. 3, 2018 (CN) ..... 2018 1 0876524

(51) Int. Cl.
*G09G 3/3258* (2016.01)

(52) U.S. Cl.
CPC ... *G09G 3/3258* (2013.01); *G09G 2320/0233* (2013.01); *G09G 2320/045* (2013.01); *G09G 2320/0626* (2013.01); *G09G 2360/16* (2013.01)

(58) Field of Classification Search
CPC ..... G09G 3/3258; G09G 2320/045; G09G 2360/16; G09G 2320/0233; G09G 2320/0626; G09G 2320/0693; G09G 3/3233
See application file for complete search history.

(56) References Cited

U.S. PATENT DOCUMENTS

| | | | |
|---|---|---|---|
| 2017/0193905 | A1 | 7/2017 | Meng et al. |
| 2019/0122607 | A1 | 4/2019 | Yan |
| 2019/0206326 | A1 | 7/2019 | Wang et al. |

FOREIGN PATENT DOCUMENTS

| | | |
|---|---|---|
| CN | 105405405 | 3/2016 |
| CN | 106782306 | 5/2017 |
| CN | 107784975 | 3/2018 |
| CN | 108039146 | 5/2018 |

*Primary Examiner* — Abhishek Sarma

(57) ABSTRACT

An organic light emitting diode (OLED) illumination compensating method and device includes obtaining a plurality of first brightness values and corresponding actual driving voltage values; establishing a mapping relationship between brightness values and actual driving voltage values based on the plurality of first brightness values and the plurality of actual driving voltage values; obtaining target brightness values of the plurality of pixel units, and obtaining target driving voltage values of the plurality of pixel units by way of calculation based on the mapping relationship and the target brightness values; compensating for brightness of the plurality of pixel units based on the target driving voltage values and current actual driving voltage values.

9 Claims, 3 Drawing Sheets

OLED ILLUMINATION COMPENSATING METHOD AND DEVICE

RELATED APPLICATIONS

This application is a National Phase of PCT Patent Application No. PCT/CN2018/114116 having International filing date of Nov. 6, 2018, which claims the benefit of priority of Chinese Patent Application No. 201810876524.5 filed on Aug. 3, 2018. The contents of the above applications are all incorporated by reference as if fully set forth herein in their entirety.

FIELD AND BACKGROUND OF THE INVENTION

The present application relates to display technologies, and more particularly, to an organic light emitting diode (OLED) illumination compensating method and device.

Active matrix organic light emitting diodes (AMOLEDs) relate to display technologies applicable to televisions and mobile devices. Compared with current mainstream liquid crystal displays (LCDs). OLED displays have merits of high contrast, wide viewing angles, low power consumption, compact size, and slim profiles, and have the potential to become a next generation of flat display technologies and currently attract the most attention among the flat display technologies.

However, AMOLED display technologies still have obvious defects. Nonuniform luminance of screens may be caused by heterogeneity in manufacturing panels and differences between driving thin-film transistors (TFTs) and between devices. Even though some compensation solutions reduce the effects of Vth, the result is that complicated compensating circuits reduce the aperture ratio of pixels and restrict pixels per inch (PPI) performance to a certain degree. Deposition makes differences in properties between sub pixels. For example, the voltage across the OLED and luminous efficiency may not the same for the sub pixels. As depicted in FIG. 2, because them is impedance in a current transmission path, voltage depletion may occur during the transmission and the current actually loaded between two terminals of the OLED is smaller than ELVDD. This makes ELVDD brightness less than a set value. The more distance to a power management integrated circuit (PMIC), the greater the ELVDD loss and the lower the brightness. This phenomenon is called IR-drop. An existing solution utilizes external optical de-mura compensation to make the panel function normally. However, this approach cannot efficiently reduce the mura caused by the R-drop. After compensated, the display effect is still unsatisfactory. Brightness of the pixels away from the PMIC may be too high after the compensation.

Therefore, there is a need to improve the drawbacks in existing art.

Technical Problems

The objective of the embodiments of the present application is to provide an organic light emitting diode (OLED) illumination compensating method and device, which has a beneficial effect of improving display quality.

Technical Solutions

Embodiments of the present application provide an organic light emitting diode (OLED) illumination compensating method, provided for compensation for a plurality of pixel units of a display panel, the method including steps of:

detecting the display panel using a detecting device to obtain first brightness values and corresponding actual driving voltage values at a plurality of predetermined gray levels for each of the pixel units;

establishing a mapping relationship between brightness values and actual driving voltage values based on the plurality of first brightness values and the plurality of actual driving voltage values;

obtaining target brightness values of the plurality of pixel units, and obtaining target driving voltage values of the plurality of pixel units by way of calculation based on the mapping relationship and the target brightness values;

compensating for brightness of the plurality of pixel units based on the target driving voltage values and a current actual driving voltage value of each of the pixel units.

In the OLED illumination compensating method of the present application, the step of obtaining the first brightness values and the corresponding actual driving voltage values at the plurality of predetermined gray levels for each of the pixel units includes:

obtaining the detected first brightness values of the plurality of pixel units at the plurality of predetermined gray levels;

obtaining an equivalent line resistance Ri between any two adjacent pixel units of each row and an initial driving voltage ELVDD inputted to a front end of the row of the pixel units under the first brightness value;

calculating the actual driving voltage value for each of the pixel units based on the equivalent resistance Ri and the initial driving voltage ELVDD.

In the OLED illumination compensating method of the present application, the step of calculating the actual driving voltage value for each of the pixel units based on the equivalent resistance Ri and the initial driving voltage ELVDD includes:

calculating the actual driving voltage value Vti for each of the pixel units according to the following two formulas:

$$\frac{R}{k} = \frac{\left(\sqrt{L_P} - \sqrt{L_Q}\right)\cdot(ELVDD - \mathrm{DATA})}{\left(\sqrt{L_P}\sum_{n}^{Q} nL_n - \sqrt{L_Q}\sum_{m}^{P} mL_m\right)}; \text{ and}$$

$$V_{ti} = \mathrm{DATA}_i - \left(ELVDD - \frac{R}{k}\sum_{m}^{i}(mL_m)\right);$$

wherein DATA is a grey-level voltage value for a same gray level. Lp and Lq are brightness values. k is luminous efficiency of OLED devices, wherein any two adjacent pixel units of each row have a same equivalent line resistance Ri therebetween, which refers to R.

In the OLED illumination compensating method of the present application, the step of establishing the mapping relationship between the brightness values and the actual driving voltage values based on the plurality of first brightness values and the plurality of actual driving voltage values includes:

establishing the mapping relationship between the brightness values and the actual driving voltage values based on a formula, $L_i = kC(V_{ti})^2$, the plurality of first brightness values, and the plurality of actual driving voltage values, wherein the mapping relationship is a L-Vt curve, wherein C is a constant related to carrier mobility and channel capacitance properties of thin-film transistors of the pixel units.

In the OLED illumination compensating method of the present application, the step of compensating for the brightness of the plurality of pixel units based on the target driving voltage values and the current actual driving voltage value of each of the pixel units includes:

obtaining a target gray-level voltage DATA' and a target gray level g' based on the target driving voltage value;

adjusting each of the pixel units based on the current actual driving voltage value, the target gray-level voltage DATA', and the target gray level g' of each pixel unit.

Embodiments of the present application further provide an organic light emitting diode (OLED) illumination compensating method, provided for compensation for a plurality of pixel units of a display panel, the method including steps of:

obtaining first brightness values and corresponding actual driving voltage values at a plurality of predetermined gray levels for each of the pixel units;

establishing a mapping relationship between brightness values and actual driving voltage values based on the plurality of first brightness values and the plurality of actual driving voltage values;

obtaining target brightness values of the plurality of pixel units, and obtaining target driving voltage values of the plurality of pixel units by way of calculation based on the mapping relationship and the target brightness values;

compensating for brightness of the plurality of pixel units based on the target driving voltage values and a current actual driving voltage value of each of the pixel units.

In the OLED illumination compensating method of the present application, the step of obtaining the first brightness values and the corresponding actual driving voltage values at the plurality of predetermined gray levels for each of the pixel units includes:

obtaining the detected first brightness values of the plurality of pixel units at the plurality of predetermined gray levels;

obtaining an equivalent line resistance Ri between any two adjacent pixel units of each row and an initial driving voltage ELVDD inputted to a front end of the row of the pixel units under the first brightness value;

calculating the actual driving voltage value for each of the pixel units based on the equivalent resistance Ri and the initial driving voltage ELVDD.

In the OLED illumination compensating method of the present application, the step of calculating the actual driving voltage value for each of the pixel units based on the equivalent resistance Ri and the initial driving voltage ELVDD includes:

calculating the actual driving voltage value Vti for each of the pixel units according to the following two formulas:

$$\frac{R}{k} = \frac{\left(\sqrt{L_P} - \sqrt{L_Q}\right)\cdot(ELVDD - \mathrm{DATA})}{\left(\sqrt{L_P}\sum_{n}^{Q} nL_n - \sqrt{L_Q}\sum_{m}^{P} mL_m\right)}; \text{ and}$$

$$V_{ti} = \mathrm{DATA}_i - \left(ELVDD - \frac{R}{k}\sum_{m}^{i}(mL_m)\right);$$

wherein DATA is a grey-level voltage value for a same gray level, Lp and Lq are brightness values, k is luminous efficiency of OLED devices, wherein any two adjacent pixel units of each row have a same equivalent line resistance Ri therebetween. which refers to R.

In the OLED illumination compensating method of the present application, the step of establishing the mapping relationship between the brightness values and the actual driving voltage values based on the plurality of first brightness values and the plurality of actual driving voltage values includes:

establishing the mapping relationship between the brightness values and the actual driving voltage values based on a formula, $L_i = kC(V_{ti})^2$, the plurality of first brightness values, and the plurality of actual driving voltage values, wherein the mapping relationship is a L-Vt curve, wherein C is a constant related to carrier mobility and channel capacitance properties of thin-film transistors of the pixel units.

In the OLED illumination compensating method of the present application, the step of compensating for the brightness of the plurality of pixel units based on the target driving voltage values and the current actual driving voltage value of each of the pixel units includes:

obtaining a target gray-level voltage DATA' and a target gray level g' based on the target driving voltage value;

adjusting each of the pixel units based on the current actual driving voltage value, the target gray-level voltage DATA', and the target gray level g' of each pixel unit.

An organic light emitting diode (OLED) illumination compensating device, configured for compensation for a plurality of pixel units of a display panel, includes:

a first obtaining module, configured to obtain first brightness values and corresponding actual driving voltage values at a plurality of predetermined gray levels for each of the pixel units;

an establishing module, configured to establish a mapping relationship between brightness values and actual driving voltage values based on the plurality of first brightness values and the plurality of actual driving voltage values;

a calculating module, configured to obtain target brightness values of the plurality of pixel units, and obtain target driving voltage values of the plurality of pixel units by way of calculation based on the mapping relationship and the target brightness values;

a compensating module, configured to compensate for brightness of the plurality of pixel units based on the target driving voltage values and a current actual driving voltage value of each of the pixel units.

In the OLED illumination compensating device of the present application, the first obtaining module includes:

a first obtaining unit, configured to obtain the detected first brightness values of the plurality of pixel units at the plurality of predetermined gray levels;

a second obtaining unit, configured to obtain an equivalent line resistance Ri between any two adjacent pixel units of each row and an initial driving voltage ELVDD inputted to a front end of the row of the pixel units under the first brightness value;

a first calculating unit, configured to calculate the actual driving voltage value for each of the pixel units based on the equivalent resistance Ri and the initial driving voltage ELVDD.

In the OLED illumination compensating device of the present application, the calculating module is configured to calculate the actual driving voltage value Vti for each of the pixel units according to the following two formulas:

$$\frac{R}{k} = \frac{\left(\sqrt{L_P} - \sqrt{L_Q}\right)\cdot(ELVDD - \mathrm{DATA})}{\left(\sqrt{L_P}\sum_{n}^{Q} nL_n - \sqrt{L_Q}\sum_{m}^{P} mL_m\right)}; \text{ and}$$

-continued $$V_{ti} = \mathrm{DATA}_i - \left(ELVDD - \frac{R}{k}\sum_{m}^{i}(mL_m)\right);$$

wherein DATA is a grey-level voltage value for a same gray level. Lp and Lq are brightness values, k is luminous efficiency of OLED devices, wherein any two adjacent pixel units of each row have a same equivalent line resistance Ri therebetween, which refers to R.

In the OLED illumination compensating device of the present application, the step of establishing the mapping relationship between the brightness values and the actual driving voltage values based on the plurality of first brightness values and the plurality of actual driving voltage values includes:

establishing the mapping relationship between the brightness values and the actual driving voltage values based on a formula, $L_i = kC(V_{ti})^2$, the plurality of first brightness values, and the plurality of actual driving voltage values, wherein the mapping relationship is a L-Vt curve, wherein C is a constant related to carrier mobility and channel capacitance properties of thin-film transistors of the pixel units.

In the OLED illumination compensating device of the present application, the step of compensating for the brightness of the plurality of pixel units based on the target driving voltage values and the current actual driving voltage value of each of the pixel units includes:

obtaining a target gray-level voltage DATA' and a target gray level g' based on the target driving voltage value;

adjusting each of the pixel units based on the current actual driving voltage value, the target gray-level voltage DATA', and the target gray level g' of each pixel unit.

A storage medium stores a software program. When executed on a computer, the software program makes the computer executing any one of the afore-mentioned method features.

A display device includes a processor. a memory, and a display panel. The memory stores a software program. The processor accesses the software program stored in the memory to execute any one of the afore-mentioned method features.

Beneficial Effects

By obtaining first brightness values and corresponding actual driving voltage values at a plurality of predetermined gray levels for each of the pixel units; establishing a mapping relationship between the brightness values and the actual driving voltage values based on the plurality of first brightness values and the plurality of actual driving voltage values; obtaining target brightness values of the plurality of pixel units, and obtaining target driving voltage values of the plurality of pixel units by way of calculation based on the mapping relationship and the target brightness values; compensating for brightness of the plurality of pixel units based on the target driving voltage values and a current actual driving voltage value of each of the pixel units, the present application yields a beneficial effect of improving display quality and lowering color deviation.

BRIEF DESCRIPTION THE SEVERAL VIEWS OF THE DRAWINGS

To illustrate the technical solutions in the embodiments of the present application more clearly, the following briefly introduces the accompanying drawings required for describing the embodiments of the present application. Apparently, the accompanying drawings in the following description show some embodiments of the present application, and a person of ordinary skill in the art may still derive other drawings from these accompanying drawings without creative efforts.

DESCRIPTION OF SPECIFIC EMBODIMENTS OF THE INVENTION

Figure 1:
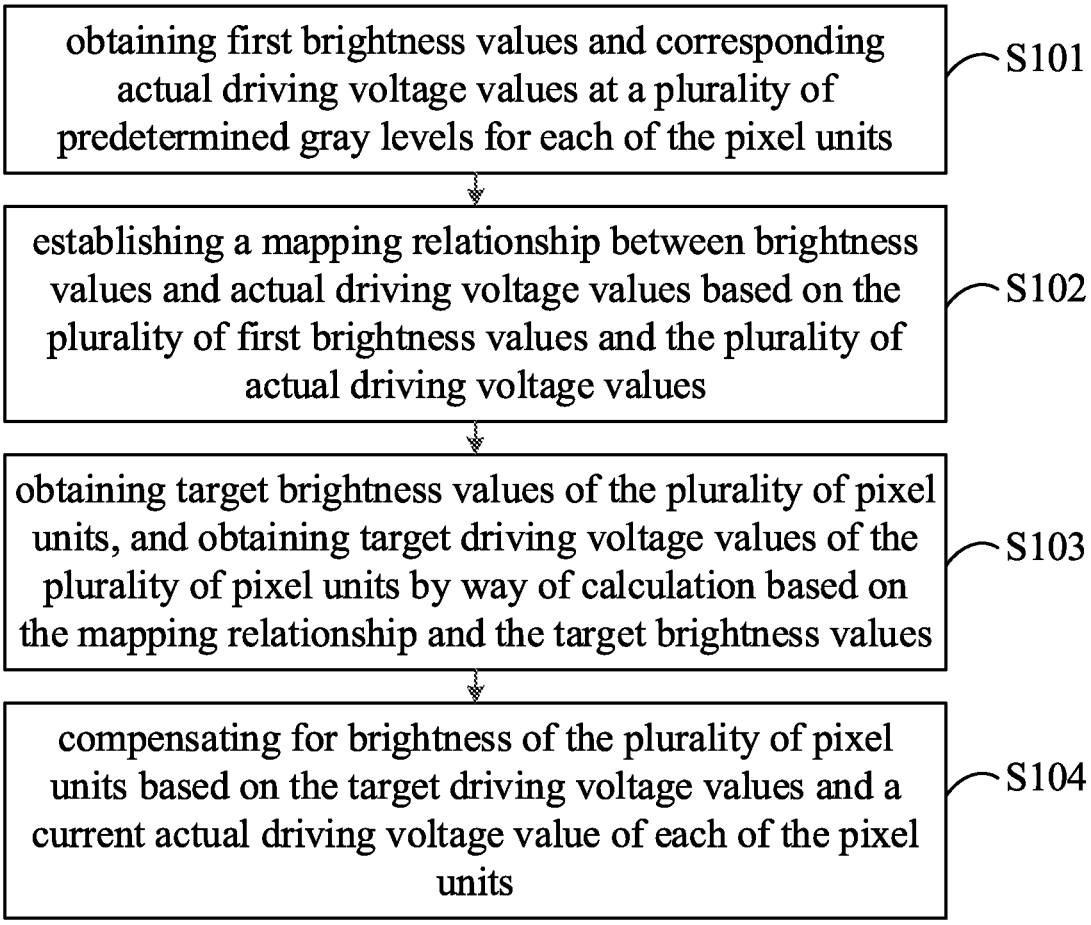
FIG. 1 is a flowchart of an organic light emitting diode (OLED) illumination compensating method in accordance with an embodiment of the present application.
Figure 2:
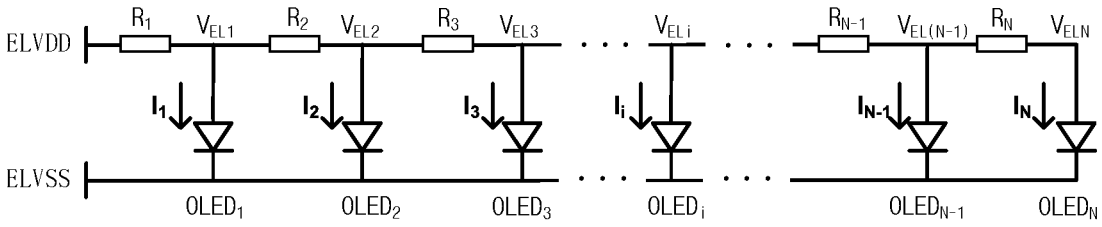
FIG. 2 is a schematic structural diagram showing an equivalent circuit in driving pixels of a display panel in accordance with the present application.

The embodiments of the present application will be described in detail below.

The embodiments are illustrated in the appending drawings, in which the same or similar reference numbers are throughout referred to as the same or similar components or the components having the same or similar functions. The embodiments described below with reference to the appending drawings are exemplary and are merely used to illustrate the present application, and should not be construed as limitations of the present application.

In the description of the present application, it is to be understood that the terms "center", "longitudinal", "lateral", "length", "width", "thickness", "upper", "lower", "front", "rear", "left", "right", "vertical", "horizontal", "top", "bottom", "inner", "outer", "clockwise", "counterclockwise" and the like indicated orientation or positional relationship based on the relationship of the position or orientation shown in the drawings, which is only for the purpose of facilitating describing the description and simplifying the description, but is not intended or implied that the device or element referred to must have a specific orientation, and be constructed and operated in a particular orientation. Therefore, it should not be understood as a limitation of the present application. In addition, terms such as "first" and "second" are used herein for purposes of description and are not intended to indicate or imply relative importance or imply the number of features. Thus, the feature defined with "first" and "second" may include one or more of this feature. In the description of the present application, "a plurality of" means two or more than two, unless specified otherwise.

In the description of the present application, it is noted that unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures; may also be inner communications of two elements, which can be understood by those skilled in the art according to specific situations.

In the present application, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed therebetween. Furthermore, a first feature "on." "above" or "on top of" a second feature may include an embodiment in which the first feature is right or obliquely "on," "above" or "on top of" the second feature, or just means that the first feature is at a height higher than that of the second feature; while a first feature "below," "under" or "on bottom of" a second feature may include an embodiment in which the first feature is right or obliquely "below." "under" or "on bottom of" the second feature, or just means that the first feature is at a height lower than that of the second feature.

The following disclosure provides many different embodiments or examples to implement different structures of the present application. In order to simplify the disclosure of the present application, the components and arrangements of specific examples are described in the following. Apparently, they are just exemplary, and do not intend to limit the present application. In addition, reference numbers and/or letters can be repeated in different examples of the present application for the purposes of simplification and clearness, without indicating the relationships between the discussed embodiments and/or arrangements. Further, the present application provides examples of various specific processes and materials, but an ordinary person in the art can realize the availability of other processes and/or usage of other materials.

FIG. 1 is a flowchart of an organic light emitting diode (OLED) illumination compensating method in accordance with an embodiment of the present application. The method is provided to compensate for a plurality of pixel units of a display panel. Referring to FIG. 1, the method includes steps of:

Step S101—obtaining first brightness values and corresponding actual driving voltage values at a plurality of predetermined gray levels for each of the pixel units.

In this step, a delicate detecting device may be used to detect the first brightness value of each of the pixel units when the display panel emits light. The actual driving voltage value of each of the pixel units is obtained by way of calculation based on an equivalent resistance Ri between any two adjacent pixel units of each row of the pixel units.

Specifically. Step S101 includes:

Step S1011—obtaining the detected first brightness values of the plurality of pixel units at the plurality of predetermined gray levels; Step S1012—obtaining an equivalent line resistance Ri between any two adjacent pixel units of each row and an initial driving voltage ELVDD inputted to a front end of the row of the pixel units under the first brightness value; Step S1013—calculating the actual driving voltage value for each of the pixel units based on the equivalent resistance Ri and the initial driving voltage ELVDD.

In Step S1013. the actual driving voltage value Vti for each of the pixel units may be calculated based on the following two formulas:

$$\frac{R}{k} = \frac{\left(\sqrt{L_P} - \sqrt{L_Q}\right)\cdot(ELVDD - \mathrm{DATA})}{\left(\sqrt{L_P}\sum_{n}^{Q} nL_n - \sqrt{L_Q}\sum_{m}^{P} mL_m\right)}; \text{ and}$$

-continued $$V_{ti} = \mathrm{DATA}_i - \left(ELVDD - \frac{R}{k}\sum_{m}^{i}(mL_m)\right);$$

wherein DATA is a grey-level voltage value for a same gray level, Lp and Lq are brightness values, k is luminous efficiency of OLED devices, wherein any two adjacent pixel units of each row have a same equivalent line resistance Ri therebetween, which refers to R.

Step S102—establishing a mapping relationship between brightness values and actual driving voltage values based on the plurality of first brightness values and the plurality of actual driving voltage values.

In this step. the mapping relationship between the brightness values and the actual driving voltage values is established based on a formula, $L_i = kC(V_{ti})^2$, the plurality of first brightness values, and the plurality of actual driving voltage values. The mapping relationship is a L-Vt curve. C is a constant related to carrier mobility and channel capacitance properties of thin-film transistors of the pixel units.

Step S103—obtaining target brightness values of the plurality of pixel units. and obtaining target driving voltage values of the plurality of pixel units by way of calculation based on the mapping relationship and the target brightness values.

In this step. the target brightness value is a display brightness value required by users. All of the pixel units have a same target brightness value. Before compensation. the actual driving voltage values of the pixel units are different from each other because the resistances between the pixel units consume energy. As a result. the brightness values of the pixel units are also different from each other.

Figure 3:
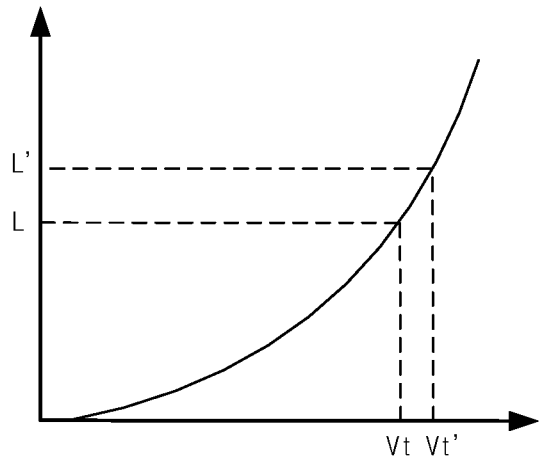
FIG. 3 is a diagram illustrating a L-V curve in the OLED illumination compensating method in accordance with an embodiment of the present application.

After obtaining the target brightness values, corresponding target driving voltage values can be found according to the curve depicted in FIG. 3.

Step S104—compensating for brightness of the plurality of pixel units based on the target driving voltage values and a current actual driving voltage value of each of the pixel units.

In this step, a target gray-level voltage DATA' and a target gray level g' are obtained based on the target driving voltage values; and each of the pixel units is adjusted based on the current actual driving voltage value, the target gray-level voltage DATA', and the target gray level g' of each pixel unit. Before compensation, the obtained actual driving voltages for the pixel units are different from each other. Accordingly, during the compensation, the degree of compensation based on the target driving voltage values is different as well.

As it can be seen that by obtaining first brightness values and corresponding actual driving voltage values at a plurality of predetermined gray levels for each of the pixel units; establishing a mapping relationship between brightness values and actual driving voltage values based on the plurality of first brightness values and the plurality of actual driving voltage values; obtaining target brightness values of the plurality of pixel units, and obtaining target driving voltage values of the plurality of pixel units by way of calculation based on the mapping relationship and the target brightness values; compensating for brightness of the plurality of pixel units based on the target driving voltage values and a current actual driving voltage value of each of the pixel units, the present application yields a beneficial effect of improving display quality and lowering color deviation.

Figure 4:
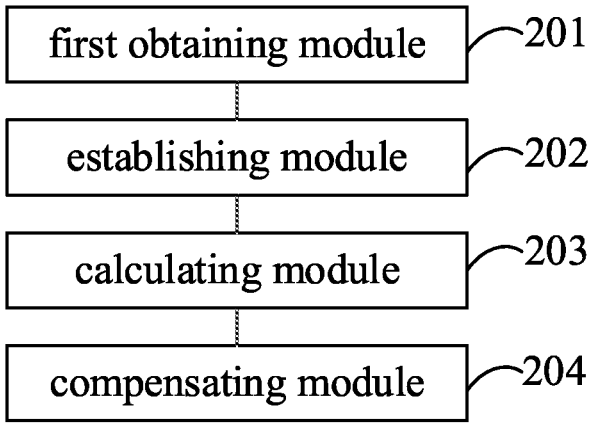
FIG. 4 is a structural diagram showing an OLED illumination compensating device in accordance with an embodiment of the present application.

FIG. 4 is a structural diagram showing an OLED illumination compensating device in accordance with an embodiment of the present application. The device is configured to compensate for a plurality of pixel units of a display panel. Referring to FIG. 4, the device includes a first obtaining module 201. an establishing module 202, a calculating module 203, and a compensating module 204.

The first obtaining module 201 is configured to obtain first brightness values and corresponding actual driving voltage values at a plurality of predetermined gray levels for each of the pixel units. In some embodiments, the first obtaining module 201 includes a first obtaining unit, configured to obtain the detected first brightness values of the plurality of pixel units at the plurality of predetermined gray levels; a second obtaining unit, configured to obtain an equivalent line resistance Ri between any two adjacent pixel units of each row and an initial driving voltage ELVDD inputted to a front end of the row of the pixel units under the first brightness value; a first calculating unit, configured to calculate the actual driving voltage value for each of the pixel units based on the equivalent resistance Ri and the initial driving voltage ELVDD.

The establishing module 202 is configured to establish a mapping relationship between brightness values and actual driving voltage values based on the plurality of first brightness values and the plurality of actual driving voltage values. The establishing module 202 establishes the mapping relationship between the brightness values and the actual driving voltage values based on a formula, $L_i=kC(V_{ti})^2$, the plurality of first brightness values, and the plurality of actual driving voltage values, wherein the mapping relationship is a L-Vt curve, wherein C is a constant related to carrier mobility and channel capacitance properties of thin-film transistors of the pixel units.

The calculating module 203 is configured to obtain target brightness values of the plurality of pixel units, and obtain target driving voltage values of the plurality of pixel units by way of calculation based on the mapping relationship and the target brightness values. Specifically, the calculating module 203 is configured to calculate the actual driving voltage value Vti for each of the pixel units according to the following two formulas:

$$\frac{R}{k}=\frac{\left(\sqrt{L_P}-\sqrt{L_Q}\right)\cdot(ELVDD-\mathrm{DATA})}{\left(\sqrt{L_P}\sum_{n}^{Q}nL_n-\sqrt{L_Q}\sum_{m}^{P}mL_m\right)};\text{ and}$$

$$V_{ti}=\mathrm{DATA}_i-\left(ELVDD-\frac{R}{k}\sum_{m}^{i}(mL_m)\right);$$

wherein DATA is a grey-level voltage value for a same gray level. Lp and Lq are brightness values, k is luminous efficiency of OLED devices, wherein any two adjacent pixel units of each row have a same equivalent line resistance Ri therebetween. which refers to R. The target brightness value is a display brightness value required by users. All of the pixel units have a same target brightness value. Before compensation, the actual driving voltage values of the pixel units are different from each other because the resistances between the pixel units consume energy. As a result, the brightness values of the pixel units are also different from each other.

The compensating module 204 is configured to compensate for brightness of the plurality of pixel units based on the target driving voltage values and a current actual driving voltage value of each of the pixel units. The compensating module 204 obtains a target gray-level voltage DATA' and a target gray level g' based on the target driving voltage value; and adjusts each of the pixel units based on the current actual driving voltage value, the target gray-level voltage DATA', and the target gray level g' of each pixel unit. Before compensation, the obtained actual driving voltages for the pixel units are different from each other. Accordingly, during the compensation, the degree of compensation based on the target driving voltage values is different as well.

As can be seen, by obtaining first brightness values and corresponding actual driving voltage values at a plurality of predetermined gray levels for each of the pixel units; establishing a mapping relationship between brightness values and actual driving voltage values based on the plurality of first brightness values and the plurality of actual driving voltage values; obtaining target brightness values of the plurality of pixel units, and obtaining target driving voltage values of the plurality of pixel units by way of calculation based on the mapping relationship and the target brightness values; compensating for brightness of the plurality of pixel units based on the target driving voltage values and a current actual driving voltage value of each of the pixel units, the present application yields a beneficial effect of improving display quality and lowering color deviation.

Figure 5:
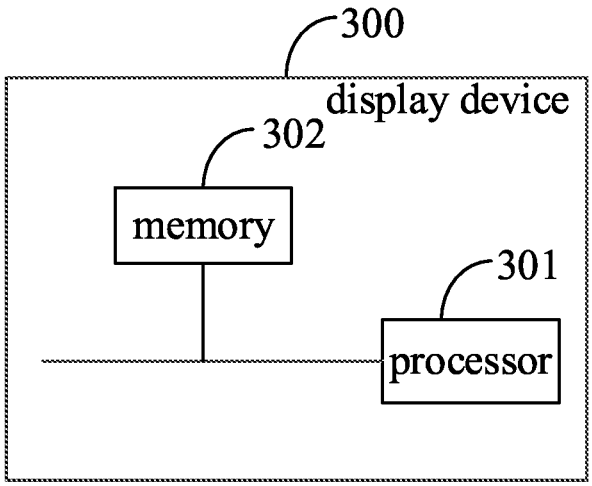
FIG. 5 is a structural diagram showing a display device in accordance with an embodiment of the present application.

Referring to FIG. 5. the present application further provides a display device 300 including a processor 301 and a memory 302. The memory 302 stores a software program. The processor 301 accesses the software program stored in the memory to execute any one of the aforementioned method features. The processor 301 is electrically connected to the memory 302. The processor 301 is a control center of the terminal 300. and is connected to various parts of the terminal by using various interfaces and lines. By running or executing the software program stored in the memory 302, and invoking data stored in the memory 302, the processor 301 performs various functions and data processing of the display device, thereby controlling the displaying.

In the present embodiment, the processor 301 of the display device 300 will load instructions corresponding to one or more than one processes of the software program into the memory 302 based on the following steps, and the software program stored in the memory 302 is executed by the processor 301 to achieve various functions, for example, by obtaining first brightness values and corresponding actual driving voltage values at a plurality of predetermined gray levels for each of the pixel units; establishing a mapping relationship between brightness values and actual driving voltage values based on the plurality of first brightness values and the plurality of actual driving voltage values; obtaining target brightness values of the plurality of pixel units, and obtaining target driving voltage values of the plurality of pixel units by way of calculation based on the mapping relationship and the target brightness values; compensating for brightness of the plurality of pixel units based on the target driving voltage values and a current actual driving voltage value of each of the pixel units.

It is noted that a person of ordinary skill in the art can realize that part or whole of the steps in the methods according to the above embodiments may be implemented by a program instructing relevant hardware. The program may be stored in a computer readable storage medium. The storage medium may include a Read-Only Memory (ROM), a Random Access Memory (RAM), a magnetic disk, or an optical disk, et al, but is not limited thereto.

Detail descriptions of the display panel provided in the embodiments of the present application are presented above. Specific examples are used in the context in illustrating the principles and embodiments of the present application. The descriptions of foregoing embodiments are only intended to facilitate understanding the present application. Any modification made to the embodiments and applications may be made by persons of ordinary skills in the art based on ideas of the present application. Above all, the present specification should not be understood as limitation to the present application.

What is claimed is:

1. An organic light emitting diode (OLED) illumination compensating method, provided for compensation for a plurality of pixel units of a display panel, the method comprising steps of:

detecting the display panel using a detecting device to obtain first brightness values and corresponding actual driving voltage values at a plurality of predetermined gray levels for each of the pixel units;

mapping between the plurality of first brightness values and the plurality of actual driving voltage values;

obtaining target brightness values of the plurality of pixel units, and obtaining target driving voltage values of the plurality of pixel units by way of calculation based on the mapping and the target brightness values;

compensating for brightness of the plurality of pixel units based on the target driving voltage values and a current actual driving voltage value of each of the pixel units, wherein the step of obtaining the first brightness values and the corresponding actual driving voltage values at the plurality of predetermined gray levels for each of the pixel units comprises:

obtaining the detected first brightness values of the plurality of pixel units at the plurality of predetermined gray levels;

obtaining an equivalent line resistance Ri between any two adjacent pixel units of each row and an initial driving voltage ELVDD inputted to a front end of the row of the pixel units under the first brightness value;

calculating the actual driving voltage value for each of the pixel units based on the equivalent resistance Ri and the initial driving voltage ELVDD, wherein the step of calculating the actual driving voltage value for each of the pixel units based on the equivalent resistance Ri and the initial driving voltage ELVDD comprises:

calculating the actual driving voltage value Vti for each of the pixel units according to the following two formulas:

$$\frac{R}{k} = \frac{(\sqrt{L_P} - \sqrt{L_Q}) \cdot |ELVDD - \mathrm{DATA}|}{\left(\sqrt{L_P}\sum_{n}^{Q} nL_n - \sqrt{L_Q}\sum_{m}^{P} mL_m\right)}; \text{ and}$$

$$V_{ti} = \mathrm{DATA}_i - \left(ELVDD - \frac{R}{k}\sum_{m}^{i}(mL_m)\right);$$

wherein DATA is a grey-level voltage value for a same gray level, Lp and Lq are brightness values, k is luminous efficiency of OLED devices, P represents a P-th column of pixel units, Q represents a Q-th column of pixel units, n is an integer ranged from 1 to Q, and m is an integer ranged from 1 to P wherein any two adjacent pixel units of each row have a same equivalent line resistance Ri therebetween, which refers to R.

2. The method according to claim 1, wherein the step of mapping between the plurality of first brightness values and the plurality of actual driving voltage values comprises:

mapping between the brightness values and the actual driving voltage values based on a formula, $L_i = kC(V_{ti})^2$, the plurality of first brightness values, and the plurality of actual driving voltage values, wherein the mapping is a L-Vt curve, wherein Li represents brightness of an i-th column of pixel units, C is a constant related to carrier mobility and channel capacitance properties of thin-film transistors of the pixel units.

3. The method according to claim 2, wherein the step of compensating for the brightness of the plurality of pixel units based on the target driving voltage values and the current actual driving voltage value of each of the pixel units comprises:

obtaining a target gray-level voltage DATA' and a target gray level g' based on the target driving voltage value;

adjusting each of the pixel units based on the current actual driving voltage value, the target gray-level voltage DATA', and the target gray level g' of each pixel unit.

4. An organic light emitting diode (OLED) illumination compensating method, provided for compensation for a plurality of pixel units of a display panel, the method comprising steps of:

obtaining first brightness values and corresponding actual driving voltage values at a plurality of predetermined gray levels for each of the pixel units;

mapping between the plurality of first brightness values and the plurality of actual driving voltage values;

obtaining target brightness values of the plurality of pixel units, and obtaining target driving voltage values of the plurality of pixel units by way of calculation based on the mapping and the target brightness values;

compensating for brightness of the plurality of pixel units based on the target driving voltage values and a current actual driving voltage value of each of the pixel units, wherein the step of obtaining the first brightness values and the corresponding actual driving voltage values at the plurality of predetermined gray levels for each of the pixel units comprises:

obtaining the detected first brightness values of the plurality of pixel units at the plurality of predetermined gray levels;

obtaining an equivalent line resistance Ri between any two adjacent pixel units of each row and an initial driving voltage ELVDD inputted to a front end of the row of the pixel units under the first brightness value;

calculating the actual driving voltage value for each of the pixel units based on the equivalent resistance Ri and the initial driving voltage ELVDD, wherein the step of calculating the actual driving voltage value for each of the pixel units based on the equivalent resistance Ri and the initial driving voltage ELVDD comprises:

calculating the actual driving voltage value Vti for each of the pixel units according to the following two formulas:

$$\frac{R}{k} = \frac{(\sqrt{L_P} - \sqrt{L_Q}) \cdot |ELVDD - \mathrm{DATA}|}{\left(\sqrt{L_P}\sum_{n}^{Q} nL_n - \sqrt{L_Q}\sum_{m}^{P} mL_m\right)}; \text{ and}$$

-continued $$V_{ti} = \mathrm{DATA}_i - \left(ELVDD - \frac{R}{k}\sum_{m}^{i}(mL_m)\right);$$

wherein DATA is a grey-level voltage value for a same gray level, Lp and Lq are brightness values, k is luminous efficiency of OLED devices, P represents a P-th column of pixel units, Q represents a O-th column of pixel units, n is an integer ranged from 1 to Q, and m is an integer ranged from 1 to P wherein any two adjacent pixel units of each row have a same equivalent line resistance Ri therebetween, which refers to R.

5. The method according to claim 4, wherein the step of mapping between the plurality of first brightness values and the plurality of actual driving voltage values comprises:

mapping between the brightness values and the actual driving voltage values based on a formula, $L_i=kC(V_{ti})^2$, the plurality of first brightness values, and the plurality of actual driving voltage values, wherein the mapping is a L-Vt curve, wherein Li represents brightness of an i-th column of pixel units, C is a constant related to carrier mobility and channel capacitance properties of thin-film transistors of the pixel units.

6. The method according to claim 5, wherein the step of compensating for the brightness of the plurality of pixel units based on the target driving voltage values and the current actual driving voltage value of each of the pixel units comprises:

obtaining a target gray-level voltage DATA' and a target gray level g' based on the target driving voltage value;

adjusting each of the pixel units based on the current actual driving voltage value, the target gray-level voltage DATA', and the target gray level g' of each pixel unit.

7. An organic light emitting diode (OLED) illumination compensating device, configured for compensation for a plurality of pixel units of a display panel, the device comprising:

a processor; and a memory connected with the processor, the memory comprising a plurality of program instructions executable by the processor to:

obtain first brightness values and corresponding actual driving voltage values at a plurality of predetermined gray levels for each of the pixel units;

map between brightness values and actual driving voltage values based on the plurality of first brightness values and the plurality of actual driving voltage values;

obtain target brightness values of the plurality of pixel units, and obtain target driving voltage values of the plurality of pixel units by way of calculation based on the mapping and the target brightness values;

compensate for brightness of the plurality of pixel units based on the target driving voltage values and a current actual driving voltage value of each of the pixel units, wherein the plurality of program instructions are executed by the processor to:

obtain the detected first brightness values of the plurality of pixel units at the plurality of predetermined gray levels;

obtain an equivalent line resistance Ri between any two adjacent pixel units of each row and an initial driving voltage ELVDD inputted to a front end of the row of the pixel units under the first brightness value;

calculate the actual driving voltage value for each of the pixel units based on the equivalent resistance Ri and the initial driving voltage ELVDD, wherein the plurality of program instructions are executed by the processor to:

calculate the actual driving voltage value Vti for each of the pixel units according to the following two formulas:

$$\frac{R}{k} = \frac{(\sqrt{L_P} - \sqrt{L_Q})\cdot|ELVDD - \mathrm{DATA}|}{\left(\sqrt{L_P}\sum_{n}^{Q} nL_n - \sqrt{L_Q}\sum_{m}^{P} mL_m\right)}; \text{ and}$$

$$V_{ti} = \mathrm{DATA}_i - \left(ELVDD - \frac{R}{k}\sum_{m}^{i}(mL_m)\right);$$

wherein DATA is a grey-level voltage value for a same gray level, Lp and Lq are brightness values, k is luminous efficiency of OLED devices, P represents a P-th column of pixel units, Q represents a O-th column of pixel units, n is an integer ranged from 1 to Q, and m is an integer ranged from 1 to P wherein any two adjacent pixel units of each row have a same equivalent line resistance Ri therebetween, which refers to R.

8. The device according to claim 7, wherein the plurality of program instructions are executed by the processor to:

map between the brightness values and the actual driving voltage values based on a formula, $L_i=kC(V_{ti})^2$, the plurality of first brightness values, and the plurality of actual driving voltage values, wherein the mapping is a L-Vt curve, wherein Li represents brightness of an i-th column of pixel units, C is a constant related to carrier mobility and channel capacitance properties of thin-film transistors of the pixel units.

9. The device according to claim 8, wherein the plurality of program instructions are executed by the processor to:

obtain a target gray-level voltage DATA' and a target gray level g' based on the target driving voltage value;

adjust each of the pixel units based on the current actual driving voltage value, the target gray-level voltage DATA', and the target gray level g' of each pixel unit.

* * * * *